US008939799B2

(12) United States Patent
Watanabe et al.

(10) Patent No.: US 8,939,799 B2
(45) Date of Patent: Jan. 27, 2015

(54) CONNECTOR

(71) Applicant: Yazaki Corporation, Minato-ku, Tokyo (JP)

(72) Inventors: Tetsuya Watanabe, Makinohara (JP); Jun Ishikawa, Ohtaku (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/022,598

(22) Filed: Sep. 10, 2013

(65) Prior Publication Data

US 2014/0073168 A1 Mar. 13, 2014

(30) Foreign Application Priority Data

Sep. 12, 2012 (JP) ..... 2012-200654

(51) Int. Cl.
*H01R 13/502* (2006.01)
*H01R 13/627* (2006.01)

(52) U.S. Cl.
CPC ..... *H01R 13/627* (2013.01); *H01R 13/6273* (2013.01)
USPC ..... 439/686

(58) Field of Classification Search
CPC ..... H01R 13/4362; H01R 13/4223
USPC ..... 439/752, 595, 744, 871, 686
See application file for complete search history.

(56) References Cited

U.S. PATENT DOCUMENTS

| | | | | |
|---|---|---|---|---|
| 5,928,011 | A * | 7/1999 | Flask et al. | 439/157 |
| 6,270,376 | B1 * | 8/2001 | Fink et al. | 439/595 |
| 6,737,585 | B2 * | 5/2004 | Aoyama et al. | 174/68.1 |
| 7,572,135 | B2 * | 8/2009 | Kozono et al. | 439/248 |
| 7,922,504 | B2 * | 4/2011 | Sakamaki et al. | 439/157 |
| 8,215,987 | B2 * | 7/2012 | Yoshioka et al. | 439/587 |
| 8,684,773 | B2 * | 4/2014 | Kobayashi et al. | 439/752 |
| 2006/0240716 | A1 | 10/2006 | Kozono et al. | |

FOREIGN PATENT DOCUMENTS

JP 2006286462 A 10/2006

* cited by examiner

*Primary Examiner* — Neil Abrams
*Assistant Examiner* — Phuongchi T Nguyen
(74) *Attorney, Agent, or Firm* — Sughrue Mion, PLLC

(57) ABSTRACT

A connector includes a first connector housing having connecting protrusions and a second connector housing having lock pieces. The first connector housing and the second connector housing are locked in a fitted state by the engagement of the connecting protrusions and the lock pieces. When free ends of the lever members are displaced inwards in a widthwise direction of the second connector housing, the distal ends of the lock pieces are displaced outwards in the widthwise direction so that the connecting protrusions and the lock pieces are disengaged. The unlock member includes a pair of unlock parts which make the free ends of the lever members to be displaced inward in the widthwise direction by being moved in a second direction perpendicular to a first direction in which the lever members extend.

2 Claims, 8 Drawing Sheets

CONNECTOR

BACKGROUND

The present disclosure relates to a connector in which, by the engagement of a pair of connecting protrusions provided on a first connector housing and a pair of lock pieces provided on a second connector housing, the connector housings are locked to each other in a fitted state.

FIG. 8 shows a connector disclosed in JP-A-2006-286462. A connector 100 includes a first connector housing 110 and a second connector housing 120.

The first connector housing 110 includes a first terminal accommodating part 112 having a tubular shape with a bottom portion which accommodates first terminal metal fittings 111, and connecting protrusions 114 protruded from a pair of outer surfaces of the first terminal accommodating part 112 that face towards opposite directions.

The second connector housing 120 includes a second terminal accommodating part 122 which is fitted to the first terminal accommodating part 112, second terminal metal fittings not shown in FIG. 8 which are held in the second terminal accommodating part 122 and connected to the first terminal metal fittings 111, and a pair of lock pieces 124.

The pair of lock pieces 124 are placed on the periphery of the second terminal accommodating part 122 to engage with the connecting protrusions 114 when the first terminal accommodating part 112 and the second terminal accommodating part 122 has engaged. In the connector 100 shown in FIG. 8, the first connector housing 110 and the second connector housing 120 are locked in a fitted state by the engagement of the pair of connecting protrusions 114 with the pair of lock pieces 124.

The lock piece 124 in the connector 100 shown in FIG. 8 includes an elastic piece 1242 extending from the base end side (in FIG. 8, right end side) towards the distal end of the second terminal accommodating part 122, and a disengaging arm 1243 which extends from the distal end 1242*a* of the elastic piece 1242 to the base end side of the elastic piece 1242. The elastic piece 1242 has an engaging hole 1241 at a position close to the distal end 1242*a*. The connecting protrusion 114 is engaged to the elastic piece 1242.

The distal end of the disengaging arm 1243 (upper side in FIG. 8 for reference) connected to the elastic piece 1242 is provided with an operating part 1244 for a pressing operation. When the operating part 1244 is pressed down in the arrow F1 direction in FIG. 8, the disengaging arm 1243 rotates as a lever, and the distal end 1242*a* of the elastic piece 1242 is displaced in the arrow F2 direction in FIG. 8. When the distal end 1242*a* of the elastic piece 1242 is displaced in the arrow F2 direction with a predetermined distance, the connecting protrusion 114 is detached from the engaging hole 1241 in the elastic piece 1242. Since the disengaging arm 1243 (lower side in FIG. 8 for reference) is similarly operated, the connecting protrusions 114 and the lock piece 124 are disengaged.

The pair of lock pieces 124 are disengaged from the connecting protrusions 114 respectively in a state that the connector housing 110 and the connector housing 120 fit with each other in the connector 100, and then the first connector housing 110 and the second connector housing 120 are moved in a separating direction respectively, thereby the first connector housing 110 and the second connector housing 120 can be separated.

In the connector 100 described in JP-A-2006-286462, to release the engagement of the first connector housing 110 and the second connector housing 120 for maintenance or the like, the pair of connecting protrusions and the pair of lock pieces must be disengaged at the same time by pressing the pair of operating parts 1244 shown in FIG. 8 at the same time.

In other words, it takes efforts to release so that operations in maintenance may be delayed.

SUMMARY

Thus, to solve the above problem, the object of the present disclosure is to provide a connector having connector housings which are locked by the engagement of a pair of connecting protrusions and a pair of lock pieces and can be easily unlocked, and the operation of separating the connector housings at the time of maintenance can be easily performed.

In order to achieve the above object, according to the present invention, there is provided a connector comprising:

- a first connector housing having a pair of outer surfaces which face towards opposite directions, wherein a pair of connecting protrusions are protruded from the outer surfaces; and
- a second connector housing having a pair of lock pieces to be engaged with the connecting protrusions,
- wherein the first connector housing and the second connector housing are locked in a fitted state by the engagement of the pair of connecting protrusions and the pair of lock pieces;
- wherein the second connector housing includes:
  - a pair of lever members which extend from distal ends of the lock pieces in a first direction; and
  - a unlock member which is attached to the second connector housing movably in a second direction perpendicular to the first direction;
- wherein the lever members have free ends, when the free ends of the lever members are displaced inwards in a widthwise direction of the second connector housing, the distal ends of the lock pieces are displaced outwards in the widthwise direction of the second connector housing so that the connecting protrusions and the lock pieces are disengaged; and
- wherein the unlock member includes:
  - a pair of unlock parts which make the free ends of the lever members to be displaced inward in the widthwise direction by being moved in the second direction; and
  - a single connecting part which connects the pair of unlock parts and which serves as an operating part for moving the pair of unlock parts in the second direction integrally.

For example, the unlock parts have taper surfaces which are inclined by a predetermined inclination angle with respect to the second direction; and

- wherein the taper surfaces of the unlock parts make the free ends of the lever members to be displaced inwards in the widthwise direction of the second connector housing.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the connector according to the present disclosure is described in detail with reference to the figures as follows.

FIGS. 1 to 7 show a connector according to one embodiment of the present disclosure.

Figure 1:
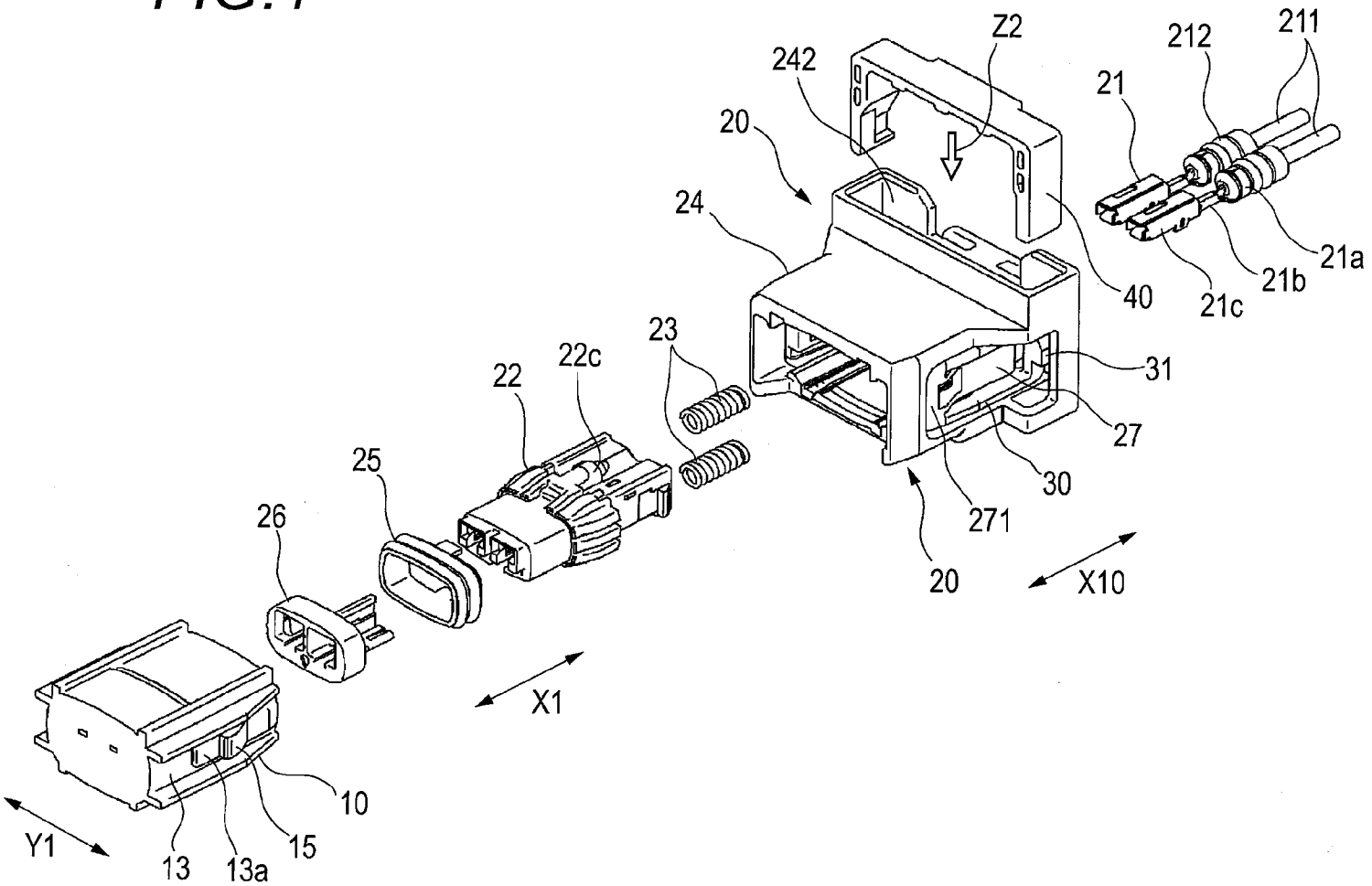
FIG. 1 is an exploded perspective view of a connector according to an embodiment of the present disclosure.

A connector 1 of this embodiment is a waterproof connector, and includes a first connector housing 10, a second connector housing 20, a pair of lever members 30 and a single unlock member 40 as shown in FIG. 1.

The first connector housing 10 includes a first terminal accommodating part 13 which accommodates first terminal metal fittings (not shown), and connecting protrusions (locking protrusions) 15 protruded from a pair of outer surfaces 13*a*, 13*a* of the first terminal accommodating part 13 that face towards opposite directions. The first terminal metal fittings, which are not shown in the figure, are tongue-like male terminal metal fittings.

The distal end portion of the first terminal accommodating part 13 has a tubular shape. The pair of outer surfaces 13*a*, 13*a* of the first terminal accommodating part 13 face towards opposite directions in the widthwise direction (arrow Y1 direction of FIG. 1) of the housing. The widthwise direction of the housing is perpendicular to the direction (arrow X1 direction of FIG. 1) the housings are fitted with each other.

Figure 2:
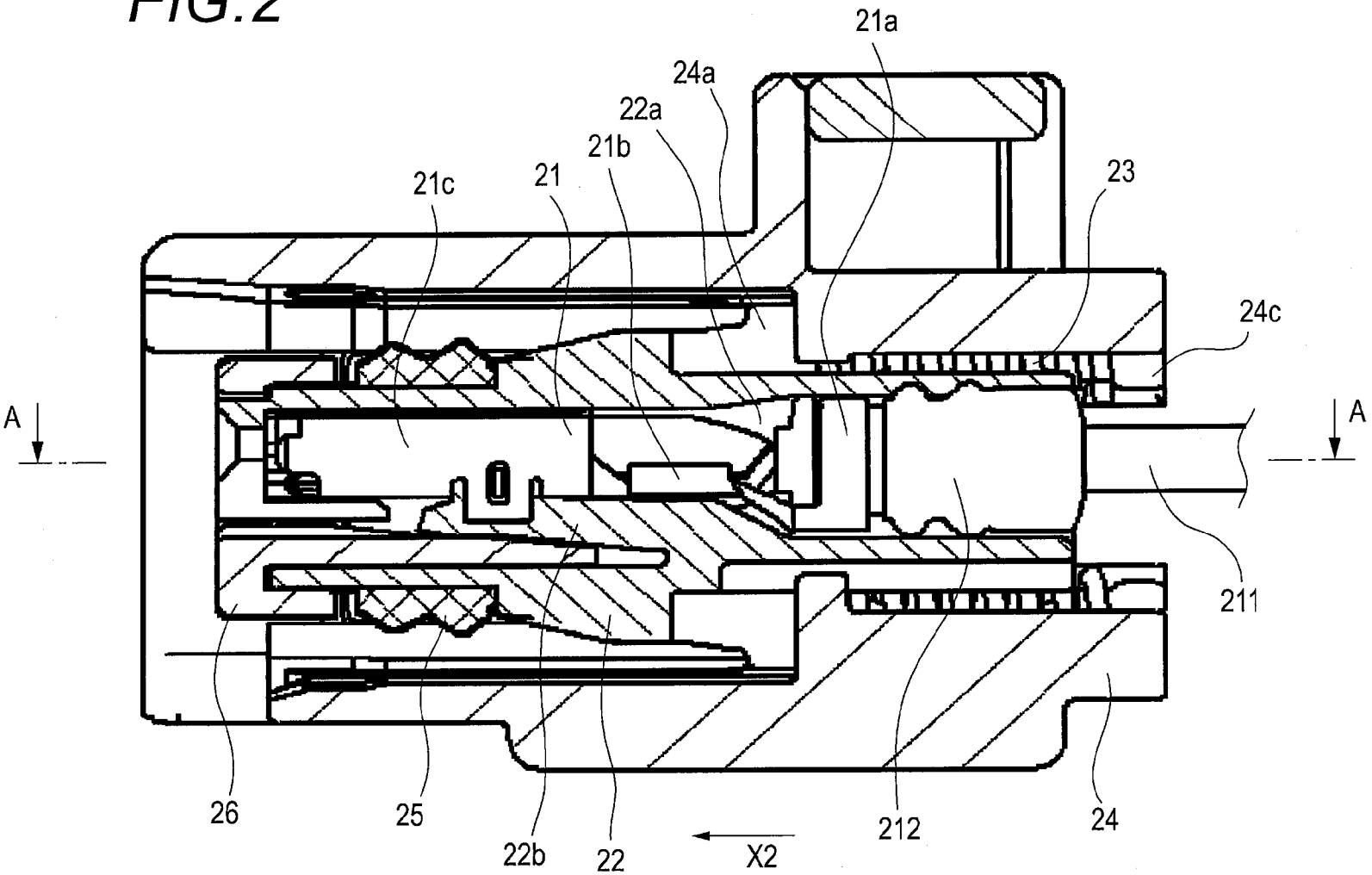
FIG. 2 is a longitudinal sectional view of an assembled state of a second connector housing shown in FIG. 1.
Figure 3:
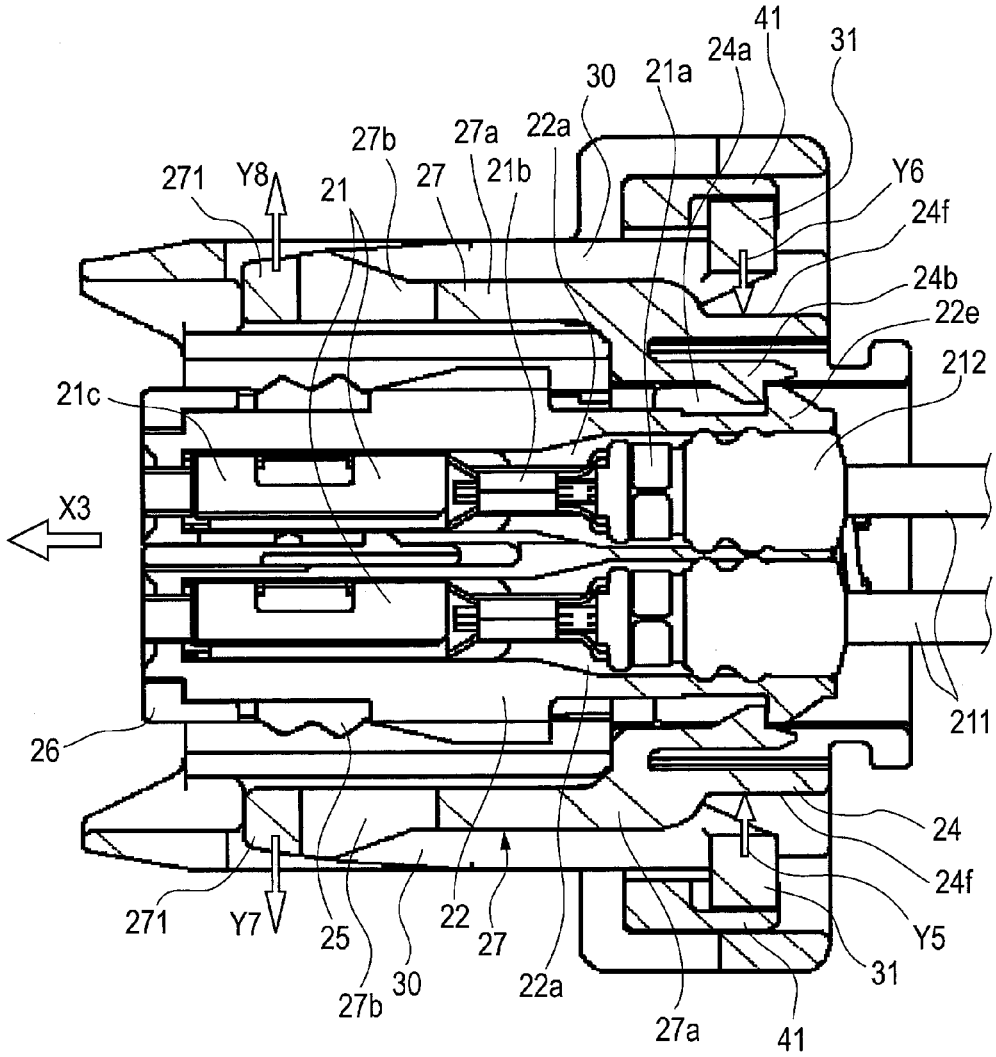
FIG. 3 is an A-A sectional view of FIG. 2.

As shown in FIGS. 1 to 3, the second connector housing 20 includes second terminal metal fittings 21, an inner housing 22, springs 23, an outer housing 24, a packing 25 as a waterproofing member, a retainer 26, and a pair of lock pieces 27.

The second terminal metal fitting 21 is a female terminal metal fitting. An electric wire 211 is crimped and connected to the base end of the second terminal metal fitting 21. The second terminal metal fitting 21 is a molded article that is made by press molding a metal plate, and has an electric wire fastening piece 21*a*, an electric wire crimping piece 21*b*, and a terminal fitting part 21*c* sequentially from the base end side. The electric wire fastening piece 21*a* is a part which is fastened on the sheath of the electric wire 211 to fix the electric wire 211. The electric wire crimping piece 21*b* is a part which is fastened on the conductor of the electric wire 211 to be electrically connected to the electric wire 211. The terminal fitting part 21*c* is formed into a square pipe structure to which the first terminal metal fitting not shown in the figure is fitted.

A waterproof stopper 212 is fitted and installed to the electric wire 211, which is connected to the base end of the second terminal metal fitting 21.

As shown in FIGS. 2 and 3, the inner housing 22 includes terminal accommodating holes 22*a* which accommodate the second terminal metal fittings 21, terminal lock lances 22*b* which retain the second terminal metal fittings 21 accommodated in the terminal accommodating hole 22*a*, and spring supporting parts 22*c* (refer to FIG. 1). The inner housing 22 accommodates the second terminal metal fittings 21 and is installed into the outer housing 24 as a second terminal accommodating part.

The spring supporting part 22*c* of the inner housing 22 is a part at which one end of the spring 23 is located. In the present embodiment, the spring 23 is a coiled compression spring. As shown in FIG. 2, the springs 23 are equipped in a compressed state between spring receiving parts 24*c* at the base end of the outer housing 24 and the inner housing 22, and urge the inner housing 22 in the arrow X2 direction of FIG. 2.

As shown in FIG. 2, the base end side of the second terminal metal fitting 21, which is inserted into the terminal accommodating hole 22*a* of the inner housing 22, is waterproofed when the waterproof stopper 212 adheres to the terminal accommodating hole 22*a*.

As shown in FIGS. 2 and 3, the outer housing 24 includes an inner accommodating hole 24*a* into which the inner housing 22 is inserted, inner lock pieces 24*b* which prevent the inner housing 22 from falling off, and the spring receiving parts 24*c*.

As shown in FIG. 3, the inner lock pieces 24*b* regulate the movement of the inner housing 22 in the falling-off direction (arrow X3 direction of FIG. 3), by engaging with retaining protrusions 22*e* protruded from the outer surfaces at the base end side of the inner housing 22.

As shown in FIG. 2, the springs 23 are equipped in a compressed state between the spring receiving parts 24*c* at the base end of the outer housing 24 and the spring supporting parts 22*c* (refer to FIG. 1), and urge the inner housing 22 so that the retaining protrusions 22*e* are maintained in a state of abutting against the inner lock pieces 24*b*.

Figure 4:
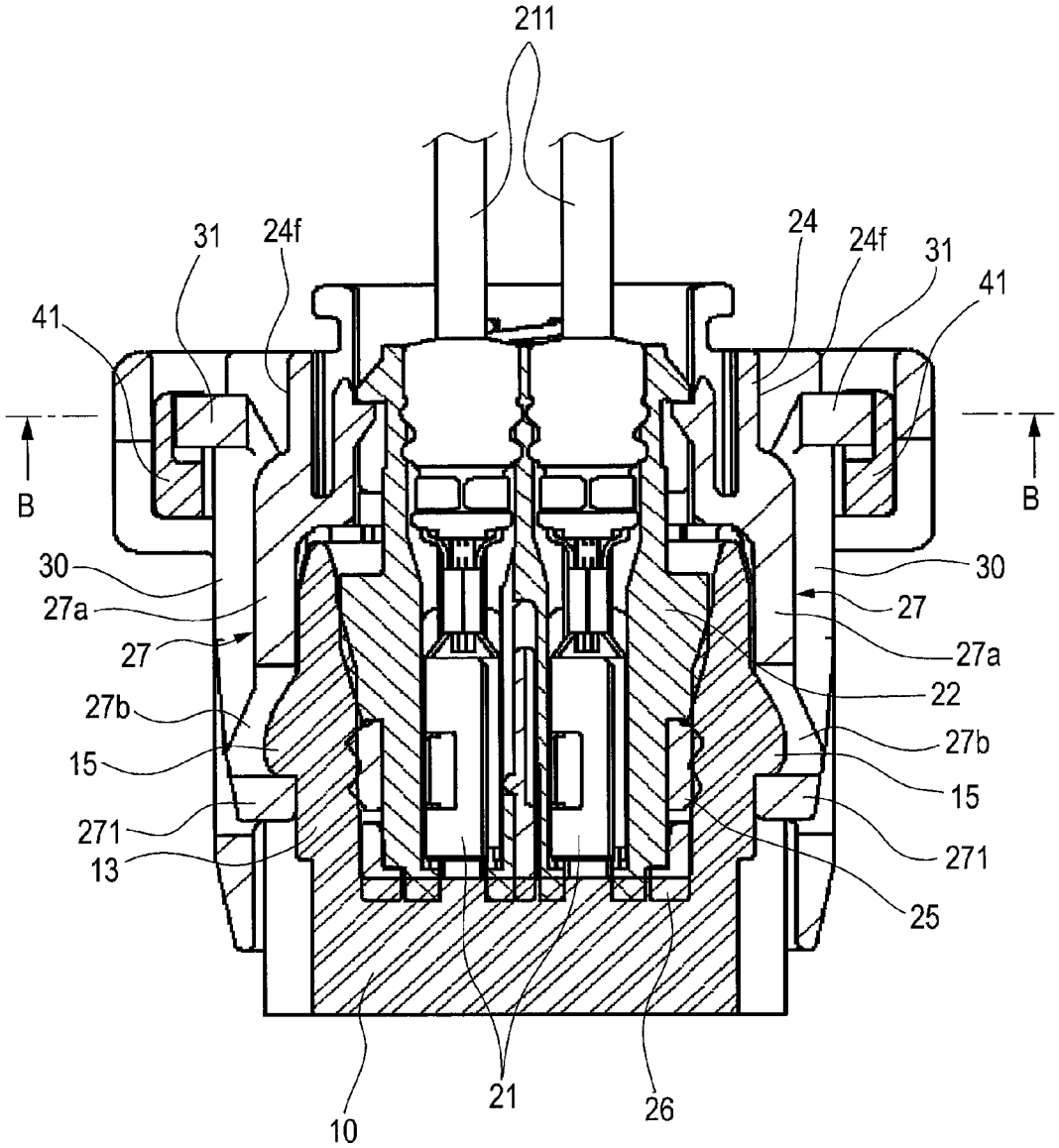
FIG. 4 is a longitudinal sectional view of the connector of the embodiment in which a first connector housing is fitted to the second connector housing shown in FIG. 3 so that the two connector housings are locked to each other.

As shown in FIGS. 2 and 3, the packing 25 is fitted and installed to the outer periphery of the inner housing 22 at the distal end side. As shown in FIG. 4, the packing 25 seals a gap between the first connector housing 10 fitted in the outer housing 24 and the inner housing 22.

As shown in FIG. 2, the retainer 26 is fitted and installed to the distal end of the inner housing 22, and retains the packing 25 and the second terminal metal fittings 21.

As shown in FIG. 4, the inner housing 22 functions as the second terminal accommodating part which is fitted with the first terminal accommodating part 13 of the first connector housing 10 when the distal end of the first connector housing 10 is inserted to the distal end side of the outer housing 24.

The pair of lock pieces 27 are provided on outer surfaces 24*f* of the outer housing 24 which are the periphery of the second terminal accommodating part. The lock pieces 27 engage with the connecting protrusions 15 at the periphery of the first terminal accommodating part 13 when the first terminal accommodating part 13 is fitted with the inner housing 22 which is the second terminal accommodating part.

The pair of lock pieces 27 have lock holes 27*b* respectively into which the connecting protrusion 15 can be engaged. The lock holes 27*b* are formed at the distal end side of elastic pieces 27*a*, which extend from the base end side to the distal end side, at the outer side surface 24*f* of the outer housing 24.

As shown in FIG. 4, the pair of lock pieces 27 lock the first connector housing 10 and the second connector housing 20 in a fitted state by engaging with the pair of connecting protrusions 15 of the first connector housing 10.

A pair of lever members 30 are formed integrally with the second connector housing 20. As shown in FIG. 3, the lever members 30 extend from distal ends 271 of the lock pieces 27 to the base end sides of the lock pieces 27. The base end of lever member 30 is a free end 31. The pair of lever members 30, when the free ends 31 which are located at the base end sides of the lock pieces 27 are displaced inwards (arrows Y5, Y6 directions of FIG. 3) in the widthwise direction of the second connector housing 20, make the distal ends 271 of the lock pieces 27 to be displaced outwards (arrows Y7, Y8 directions of FIG. 3) in the widthwise direction of the second connector housing 20 so that the connecting protrusions 15 and the lock pieces 27 are disengaged.

As shown with an arrow Z2 in FIG. 1, the single unlock member 40 is inserted into an accommodating space 242 formed in the outer housing 24, and the single unlock member 40 is attached to the outer housing 24. The direction (arrow Z2 direction of FIG. 1), in which the single unlock member 40 is inserted into the accommodating space 242, is perpendicular to the direction (arrow X10 direction of FIG. 1) in which the lever member 30 extends.

The unlock member 40 is attached to the outer housing 24 movably back and forth in the direction perpendicular to the extending direction of the lever members 30.

Figure 5:
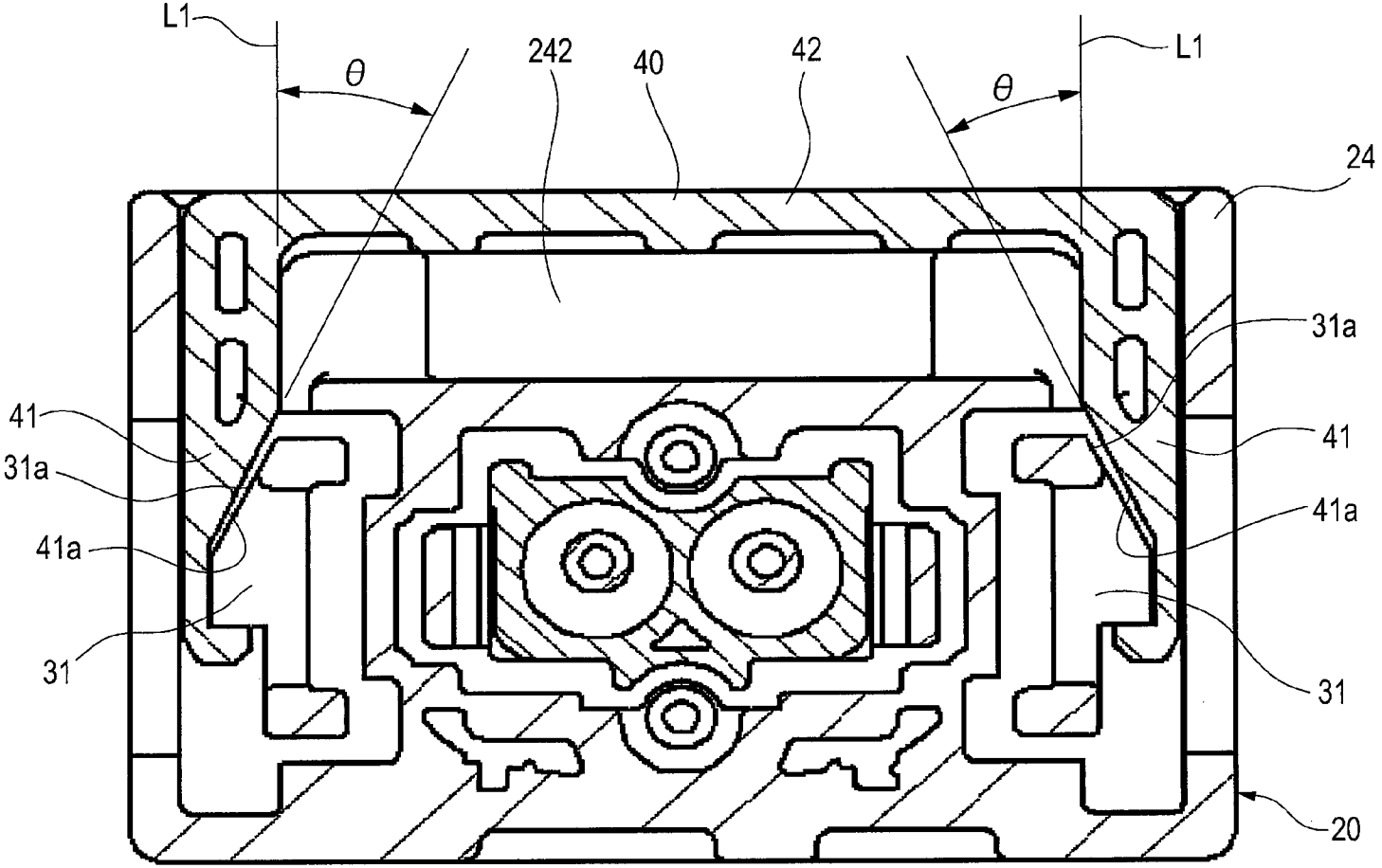
FIG. 5 is a B-B sectional view of FIG. 4.

As shown in FIGS. 1 and 5, the unlock member 40 includes a pair of unlock parts 41 and a single connecting part 42 which connects the pair of unlock parts 41.

The connecting part 42 connects the pair of unlock parts 41 so that the unlock parts 41 can move integrally, and which becomes an operating part when the pair of unlock parts 41 are moved in the direction perpendicular to the extending direction of the lever members 30.

Figure 6:
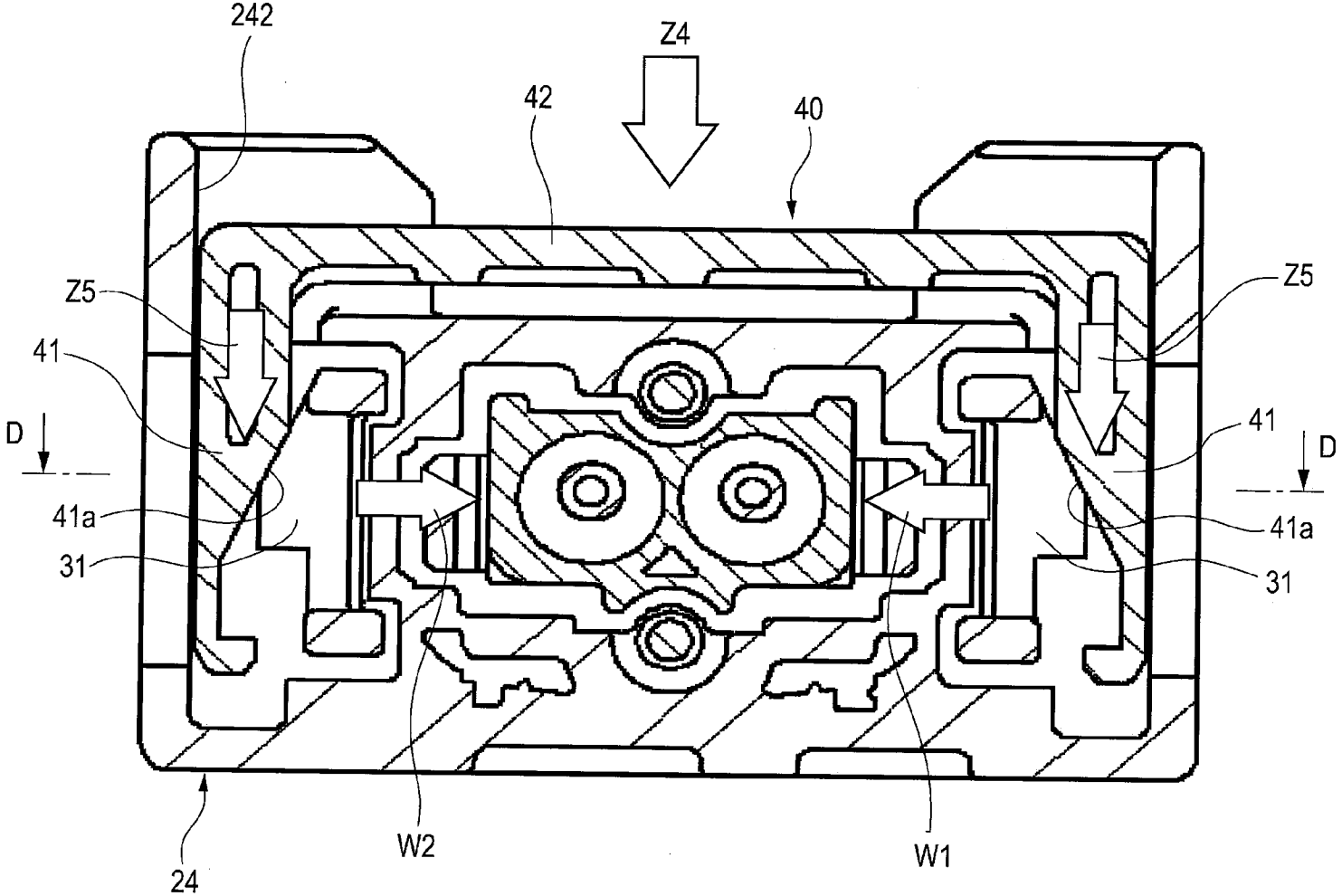
FIG. 6 is a cross-sectional view in which a connecting part of a unlock member is pressed down from the state of the connector shown in FIG. 5, to move the unlock member in a direction perpendicular to an extension direction of the lever members.

As shown in FIG. 6, when the connecting part 42 of the unlock member 40 which is attached into the accommodating space 242 is pressed down in the direction (arrow Z4 direction of FIG. 6) perpendicular to the extending direction of the lever members 30, the unlock parts 41 move in directions (arrows Z5 directions of FIG. 6) perpendicular to the extending direction of the lever members 30. The unlock member 40 makes the free ends 31 of the lever members 30 to be displaced inwards in the widthwise direction (arrows W1, W2 directions of FIG. 6) when the unlock parts 41 are moved in the arrows Z5 directions.

Figure 7:
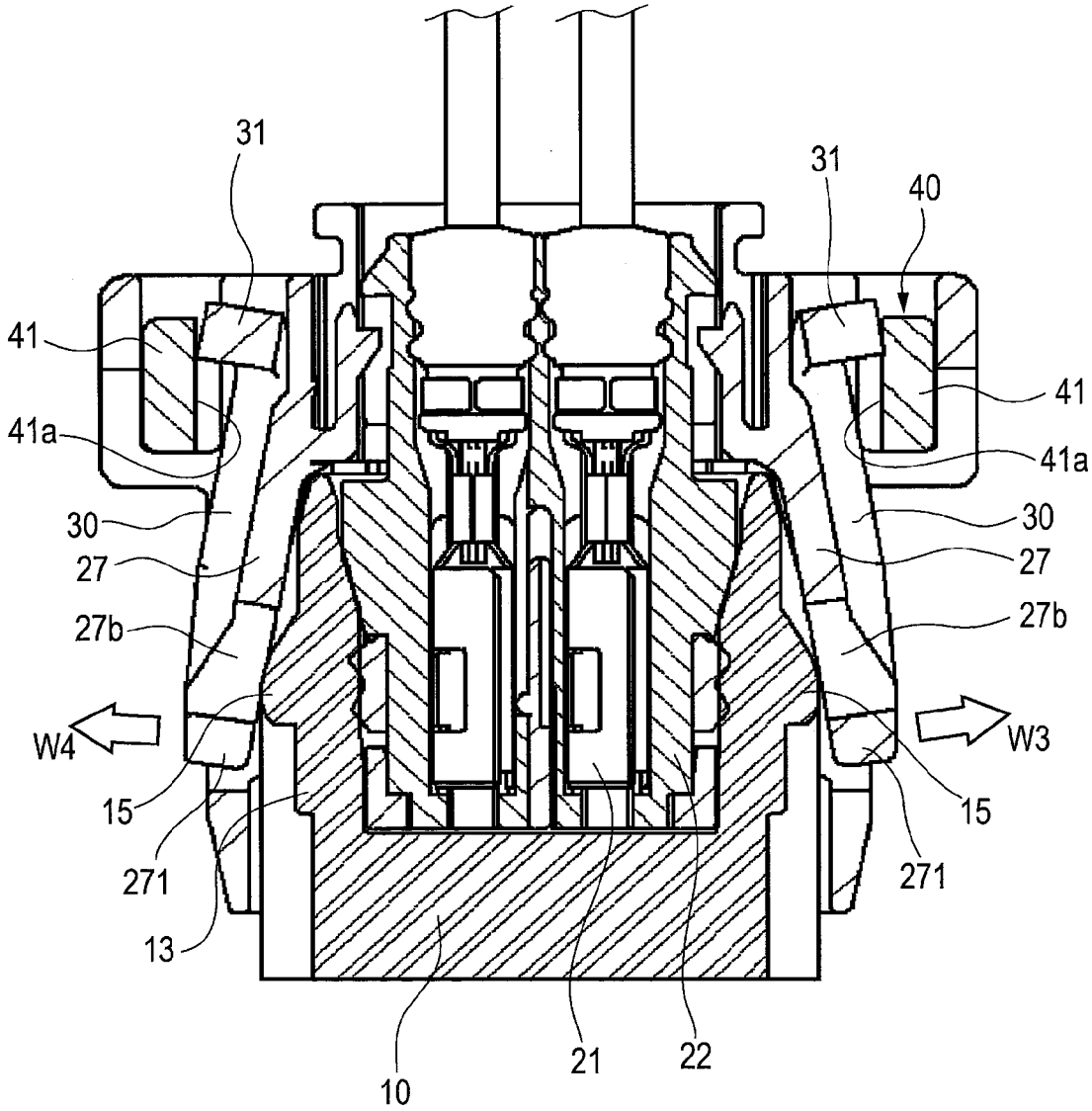
FIG. 7 is a longitudinal sectional view illustrating the action of a pair of lock pieces when the connector housings are unlocked in the connector of the embodiment, and is a D-D sectional view of FIG. 6.
Figure 8:
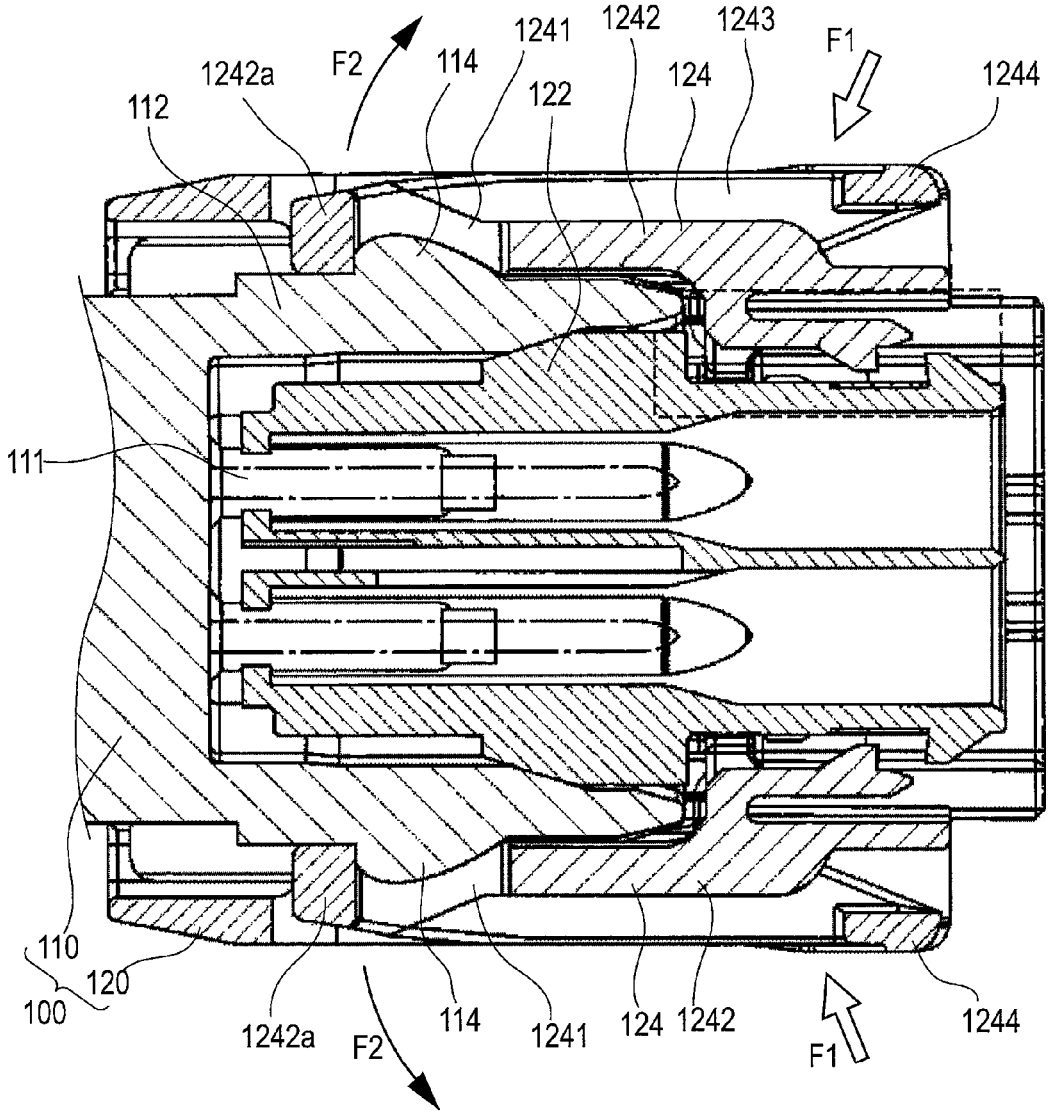
FIG. 8 is a longitudinal sectional view which shows a traditional connector in a locked state.

When the free ends 31 of the lever members 30 are displaced inwards in the widthwise direction, the distal ends 271 of the lock pieces 27 which are the distal ends of the lever members 30 are displaced outwards in the widthwise direction, that is, in the direction the connecting protrusions 15 and the lock pieces 27 are disengaged, as shown with arrows W3, W4 of FIG. 7.

In the present embodiment, as shown in FIG. 5, the unlock parts 41 makes the free ends 31 of the lever members 30 to be displaced inwards in the widthwise direction of the second connector housing 20 with taper surfaces 41*a*. The taper surfaces 41*a* are inclined with a predetermined inclination angle θ relative to a direction (the direction in which straight lines L1 extend) which is perpendicular to the extending direction of the lever members 30.

In the present embodiment, as shown in FIG. 5, to smoothly slide on the taper surfaces 41*a*, the surfaces of the free ends 31 which contact on the taper surfaces 41*a* become taper surfaces 31*a* with inclination angles substantially equal to those of the taper surfaces 41*a*.

In the case of the connector 1 of the present embodiment, to separate the first connector housing 10 and the second connector housing 20 in a locked state for maintenance or the like, after the two connector housings are unlocked, the two connector housings 10 and 20 are pulled towards directions of separating from each other.

However, as shown in FIG. 4, the first connector housing 10 and the second connector housing 20 are in a locked state by the engagement of the pair of connecting protrusions 15 and the pair of lock pieces 27. In the locked state, when the connecting part 42 of the unlock member 40 located above the second connector housing 20 is pressed down as shown in the arrow Z4 of FIG. 6, the unlock member 40 is moved in the direction perpendicular to the extending direction of the lever members 30, thereby the pair of unlock parts 41 of the unlock member 40 make the free ends 31 of the lever members 30 to be displaced inwards in the widthwise direction of the second connector housing 20.

Due to the displacement of the free ends 31 of the lever members 30, as shown in FIG. 7, the distal ends 271 of the lock pieces 27 are displaced outwardly so that the connecting protrusions 15 and the lock pieces 27 are disengaged, and the two connector housings can be unlocked.

That is, the locked connector housings can be easily unlocked by the simple operation of pressing down the connecting part 42 of the unlock member 40. Therefore, the connector housings can be easily separated from each other at the time of maintenance.

In the case of the connector 1 of the embodiment, the unlock parts 41 in the unlock member 40 make the free ends 31 of the lever members 30 to be displaced with the taper surfaces 41*a* which are inclined relative to the directions perpendicular to the extending direction of the lever members 30, and since the operation force can be set to a desired value by appropriately selecting the inclination angles of the taper surfaces 41*a*, the operation efficiency can be easily improved by reducing the operation force.

Since reaction forces applied to the taper surfaces 41*a* of the unlock parts 41 from the free ends 31 of the lever members 30 act as restoring forces with which the unlock parts 41 are returned to the original positions, if the connecting part 42 is not pressed down any more after the connector housings are detached from each other, the unlock member 40 can be automatically returned to the original position by the reaction forces applied to the unlock parts 41 from the lever members 30. Therefore, after the connector housings are detached from each other, a special operation to return the unlock member 40 to the original position is unnecessary, and handleability can be improved.

The present disclosure is not restricted to the above-described embodiments, and suitable modifications, improvements and the like can be made. Moreover, the materials, shapes, dimensions, numbers, installation places, and the like of the components in the above embodiments are arbitrarily set as far as the invention can be attained, and not particularly restricted.

For example, the shape or arrangement of the unlock member or the shape or size of the lever member or the like can be appropriately designed and changed in such a range that the same function as the embodiment can be played.

The features of the embodiment of the connector according to the present disclosure described above are briefly, collectively listed in the following [1] to [2], respectively.

[1] A connector includes a first connector housing (10) having a pair of outer surfaces (13*a*) which face towards opposite directions, wherein a pair of connecting protrusions (15) are protruded from the outer surfaces (13*a*); and a second connector housing (20) having a pair of lock pieces (27) to be engaged with the connecting protrusions (15). The first connector housing (10) and the second connector housing (20) are locked in a fitted state by the engagement of the pair of connecting protrusions (15) and the pair of lock pieces (27). The second connector housing (20) includes: a pair of lever members (30) which extend from distal ends (271) of the lock pieces (27) in a first direction; and a unlock member (40) which is attached to the second connector housing (20) movably in a second direction perpendicular to the first direction. The lever members (30) have free ends (31), when the free ends (31) of the lever members (30) are displaced inwards in a widthwise direction of the second connector housing (20), the distal ends (271) of the lock pieces (27) are displaced outwards in the widthwise direction of the second connector housing (20) so that the connecting protrusions (15) and the lock pieces (27) are disengaged. The unlock member (40) includes: a pair of unlock parts (41) which make the free ends (271) of the lever members (30) to be displaced inward in the widthwise direction by being moved in the second direction; and a single connecting part (42) which connects the pair of unlock parts (41) and which serves as an operating part for moving the pair of unlock parts (41) in the second direction integrally.

[2] In the connector (1) according to the above [1], the unlock parts (41) have taper surfaces (41*a*) which are inclined by a predetermined inclination angle with respect to the second direction, and the taper surfaces (41*a*) of the unlock parts (41) make the free ends (31) of the lever members (30) to be displaced inwards in the widthwise direction of the second connector housing (20).

According to the above configurations, to separate the first connector housing and the second connector housing in a locked state for maintenance or the like, after the two connector housings are unlocked, the two connector housings are pulled towards directions of separating from each other.

However, the first connector housing and the second connector housing are in a locked state by the engagement of the pair of connecting protrusions and the pair of lock pieces. In the locked state, when the connecting part of the unlock member located above the second connector housing is pressed down, to move the unlock member in the second direction, the pair of unlock parts of the unlock member make the free ends of the lever members to be displaced inwards in the widthwise direction of the second connector housing. Because of the displacement of the free ends of the lever members, the distal ends of the lock pieces are displaced so that the connecting protrusions and the lock pieces are disengaged, and the two connector housings can be unlocked.

That is, the locked connector housings can be easily unlocked by the simple operation of pressing down the connecting part. Therefore, the connector housings can be easily separated from each other at the time of maintenance or the like.

Also, the unlock parts of the unlock member make the free ends of the lever members to be displaced with the taper surfaces which are inclined relative to the second direction, and since the operation force can be set to a desired value by appropriately selecting the inclination angle of the taper surfaces, the operation efficiency can be easily improved by reducing the operation force.

Since reaction forces applied to the taper surfaces of the unlock parts from the free ends of the lever members act as restoring forces with which the unlock parts are returned to the original positions, if the connecting part is not pressed down any more after the connector housings are detached from each other, the unlock member can be automatically returned to the original position by the reaction forces applied to the unlock parts from the lever members. Therefore, after the connector housings are detached from each other, a special operation to return the unlock member to the original position is unnecessary, and handleability can be improved.

According to the connector of the present disclosure, when the first connector housing and the second connector housing are locked, the locked connector housings can be easily unlocked by the simple operation of pressing down the connecting part. Therefore, the connector housings can be easily separated from each other at the time of maintenance or the like.

The present application is based on Japanese Patent Application No. 2012-200654 filed on Sep. 12, 2012, the contents of which are incorporated herein by reference.

What is claimed is:

1. A connector comprising:

a first connector housing having a pair of outer surfaces which face towards opposite directions, wherein a pair of connecting protrusions are protruded from the outer surfaces; and a second connector housing having a pair of lock pieces to be engaged with the connecting protrusions, wherein the first connector housing and the second connector housing are locked in a fitted state by the engagement of the pair of connecting protrusions and the pair of lock pieces;

wherein the second connector housing includes:

a pair of lever members which extend from distal ends of the lock pieces in a first direction; and a unlock member which is attached to the second connector housing movably in a second direction perpendicular to the first direction;

wherein the lever members have free ends, when the free ends of the lever members are displaced inwards in a widthwise direction of the second connector housing, the distal ends of the lock pieces are displaced outwards in the widthwise direction of the second connector housing so that the connecting protrusions and the lock pieces are disengaged;

wherein the unlock member includes:

a pair of unlock parts which make the free ends of the lever members to be displaced inward in the widthwise direction by being moved in the second direction; and a single connecting part which connects the pair of unlock parts and which serves as an operating part for moving the pair of unlock parts in the second direction integrally.

2. The connector according to claim 1, wherein the unlock parts have taper surfaces which are inclined by a predetermined inclination angle with respect to the second direction; and wherein the taper surfaces of the unlock parts make the free ends of the lever members to be displaced inwards in the widthwise direction of the second connector housing.

* * * * *